US007476448B2

(12) United States Patent
Natsui et al.

(10) Patent No.: US 7,476,448 B2
(45) Date of Patent: Jan. 13, 2009

(54) COATING PAPER WHICH CAN BE REMOVED BY WATER AND A METHOD FOR PREPARATION THEREOF

(75) Inventors: Junpei Natsui, Tokyo (JP); Akihito Ogino, Tokyo (JP); Hiroki Midorikawa, Tokyo (JP); Yoshiaki Ishino, Shizuoka (JP); Yoshiteru Kanomata, Shizuoka (JP)

(73) Assignees: Nippon Paper Industries Co., Ltd., Tokyo (JP); Nippon Paper Papylia Co., Ltd., Shizuoka (JP)

( * ) Notice: Subject to any disclaimer, the term of this patent is extended or adjusted under 35 U.S.C. 154(b) by 184 days.

(21) Appl. No.: 11/385,295

(22) Filed: Mar. 21, 2006

(65) Prior Publication Data

US 2006/0216537 A1 Sep. 28, 2006

(30) Foreign Application Priority Data

Mar. 22, 2005 (JP) ..... 2005-082299
Jun. 1, 2005 (JP) ..... 2005-161596

(51) Int. Cl.
*B32B 23/04* (2006.01)

(52) U.S. Cl. ..... 428/532; 428/533; 428/535; 428/536; 428/537.5; 427/322; 427/324; 427/326; 427/411; 427/415

(58) Field of Classification Search ..... 428/532, 428/533, 535, 536, 537.5; 427/322, 324, 427/326, 411, 415
See application file for complete search history.

(56) References Cited

U.S. PATENT DOCUMENTS 6,506,545 B1 * 1/2003 Bulliard et al. ..... 430/429
6,890,706 B2 * 5/2005 Bulliard et al. ..... 430/486
7,247,174 B2 * 7/2007 Scheffler et al. ..... 8/648

FOREIGN PATENT DOCUMENTS

JP S43-1214 * 1/1968
JP S48-27605 4/1973
JP 09-049188 * 2/1997
JP 2004314623 11/2004

* cited by examiner

*Primary Examiner*—Leszek Kiliman
(74) *Attorney, Agent, or Firm*—Flynn, Thiel, Boutell & Tanis, P.C.

(57) ABSTRACT

A coating paper which can be removed by water comprising a substrate paper of single layer or lamellar structure having two or more layers which has at least one water decaying layer containing 5-100 wt % of water insoluble fibrous carboxy alkyl cellulose and a water base color is coated on said substrate paper, wherein a coating layer and at least a part of substrate paper which is a supporter of said coating layer has a characteristic of easily removing, dispersion and dissolving by contact with water, and can provide a water decaying coating paper used preferably for an use of label for a returnable container which may easily remove by contact with water and excellent in printing aptitude and a method for preparation thereof can be provided.

11 Claims, No Drawings

COATING PAPER WHICH CAN BE REMOVED BY WATER AND A METHOD FOR PREPARATION THEREOF

BACKGROUND OF THE INVENTION

1. Field of the Invention

The present invention relates to a coating paper formed by providing a coating layer on a substrate paper which easily swells, disperses or dissolves by contact with water and a method for the preparation thereof, and an adhesive sheet formed by providing an adhesive layer on a non-coating surface of said coating paper. More in detail, the present invention is a coating paper prepared by providing a coating layer having a characteristic for various printing methods such as offset printing, gravure printing, thermal recording method, ink-jet recording method or laser beam printing method on a substrate paper characterized in that at least a part may swell, disperse or dissolve by water, which can be preferably used for a use such as a label for a returnable container utilizing a special feature that a coating layer is easily removed by removing a part of the paper or by a dispersion or through dissolving, and further relates to a method for the preparation of said coating paper.

2. Description of the Prior Art

Recently, environmental problems are becoming an object of public interest, and a returnable container has broadly been given attention. Generally, to a returnable container, an adhesive label has been applied having an adhesive layer at a rear surface of a coating paper, on the surface of which letters or patterns are printed. However, after used, said label should be removed (released) from the container, but complicated washing work is necessary. For the purpose of making said removing work easy, investigations to improve the removing (releasing) ability of a label by using a water-soluble adhesive to an adhesive layer are carried out. However, in this case, since a coating layer and a substrate paper prevent water from entering into an adhesive layer, the remarkable effect cannot be accomplished.

To solve said problem, a water-decaying adhesive sheet characterized by providing a coating layer suited for various recording systems on a substrate paper prepared by using a water-soluble material or water-dispersible material and providing an adhesive layer on a non-coating layer is disclosed in Patent Document 1.

The construction of a water-decaying thermally sensitive recording sheet disclosed in Patent Document 1 and a water-decaying adhesive sheet which uses said water-decaying thermally sensitive recording sheet is characterized by providing a specific filling layer and a coating layer (thermally sensitive recording layer) on a water-soluble or water-dispersible substrate paper and providing an adhesive layer on a non-coating layer, and make it possible to remove a label easily from a returnable container by using a water-soluble paper or water-dispersible paper as a substrate paper. In the present invention, a water-soluble paper is a paper which has a feature of dispersing fibrously in water within a very small amount of time of 5-20 seconds and partially dissolves in water, and a method for the preparation thereof is disclosed in Patent Documents 2 and 3. That is, various additives (filler, sizing agent, dye or pigment) are added to water-soluble fibers, if necessary, and can be prepared by ordinary paper making methods. Said water-soluble paper is not only actually used as a printing paper or a writing paper but also can be used as a water-soluble adhesive label or a water-soluble bag by providing adherence or heat-sealing ability by carrying out secondary processing such as coating, adhering or laminating.

Further, in the present invention, a water-dispersible paper is a paper which has a characteristic of disaggregating in water and becoming small fragments, and is mainly used as a toilet tissue which can be disposed in a flush toilet after being used.

Further, in general, in a case when a coating liquid consisting of an aqueous solution of a water-soluble resin or water dispersion of a water-insoluble resin is coated on a substrate paper made of a water-soluble paper or water-dispersible paper using a bar coater method, knife coating method, roll coating method, blade coating method, die coating method or gravure coating method, then dried, a water-soluble paper or water-dispersible paper, which is a substrate paper, has a tendency to swell excessively and cause a problem of breaking in a coating machine.

To solve said problem, in Patent Document 1, the following methods are disclosed. That is, (1) forming a filling layer by coating and drying a water-soluble resin or a water-dispersible resin dissolved in an organic solvent by a publicly known method such as a bar coater method utilizing features that a water-soluble paper or water-dispersible paper do not disperse or dissolve in an organic solvent. (2) Forming a water-soluble filling layer using a water-soluble resin which can be applied by an extrusion method using an extrusion molding machine, and further forming a filling layer composed of a water-insoluble resin on the water-soluble filling layer.

However, a water-decaying thermally sensitive recording sheet and a water-decaying adhesive sheet using said water-decaying thermally sensitive recording sheet disclosed in Patent Document 1 has a problem that the manufacturing cost becomes high because an expensive organic solvent is used and an additional coating process besides a coating process of a coating layer (thermally sensitive recording layer) is necessary. Further, a decaying feature of a filling layer formed by coating an organic solvent coating using a water-soluble resin or water-dispersible resin which can dissolve in an organic solvent is inferior when compared with that of a water-soluble paper or water-dispersible paper used as a substrate material or with that of a coating layer provided on a substrate paper and, therefore, when washed by water, it is removed in a film state and causes a problem of stuffing a drainpipe.

Further, in Patent Document 4, a water-dispersible sheet formed by providing a coating layer on a substrate paper of a water-soluble paper or water-dispersible paper is disclosed. However, said sheet is not sufficient in its decaying feature by water in the suited grammage region as a substrate paper of coating paper.

As mentioned above, a coating paper which has both a good decaying feature by water and characteristic as a coating paper (printing aptitude) and a method for the preparation thereof have not been accomplished yet.

Patent Document 1: JP2004-314623A Publication

Patent Document 2: Japanese Patent S43-1214 Publication

Patent Document 3: Japanese Patent S48-27605 Publication

Patent Document 4: JPH09-49188A Publication

SUMMARY OF THE INVENTION

The object of this invention is to provide a paper coating which can be removed (released) easily by contact with water and has an excellent printing aptitude, characterized in having a feature that at least a part of a coating layer and a substrate paper easily swell, disperses or dissolves when contacted with water and suited for use as a label for a returnable container and a method for preparation of said coating paper.

The inventors of the present invention have continued an eager investigation to accomplish said object and found the following fact. That is, in a coating paper prepared by coating a water base color on a substrate paper of a single layer or lamellar structure having two or more layers which has at least one water-decaying layer containing 5-100 wt % of water-insoluble fibrous carboxy alkyl cellulose, it is very important to contain an alkalizing agent in said substrate paper and accomplished present invention. Further, the inventors of the present invention have found that to coat a water base color on one surface of a substrate paper composed of a lamellar structure of a single layer or having two or more layers of said water-decaying layer and to contain an alkalizing agent from a non-coating surface is very important for the method for preparation, and accomplished the present invention.

Especially, when the grammage of a substrate paper is 50 g/m$^2$ or more, a coating layer which is excellent in printing aptitude and can be preferably used for a label for a returnable container can be obtained by using a substrate paper of a single layer or a lamellar structure having two or more layers which has at least one layer containing 30-60 wt % of fibrous carboxy alkyl cellulose and 40-70 wt % of water-dispersible fibers for paper manufacturing beaten to 550-650 mlCSF measured by Canadian standard freeness.

According to the present invention, a coating layer and at least a part of substrate paper which is a supporter of said coating layer has a characteristic of being easily removed, dispersed and dissolved when contacted with water, and can provide a water-decaying coating paper used preferably as a label for a returnable container which may be easily removed by contact with water, has an excellent printing aptitude and a method for the preparation thereof can be provided.

DESCRIPTION OF THE PREFERRED EMBODIMENT

The coating paper which can be removed by water of the present invention, as the first step, is formed by a coating layer which is suited for various printing methods by coating and drying a water base color liquid on a substrate paper containing water-insoluble fibrous carboxy alkyl cellulose. The substrate paper containing the water-insoluble fibrous carboxy alkyl cellulose is insoluble in water and does not excessively swell in water. Therefore, it does not cause breaking problem based on the deterioration of a substrate paper during the coating process and, by containing an alkalizing agent in the coating paper, acidic carboxy alkyl group of the fibrous carboxy alkyl cellulose and the alkalizing agent react and form an alkali salt of a water-soluble fibrous carboxy alkyl cellulose.

According to the above-mentioned processes, a coating paper which can be removed by water of the present invention having a coating layer suited to various printing systems on a substrate paper and which disperses or dissolves in water can be obtained.

The water-insoluble fibrous carboxy alkyl cellulose contained in a substrate paper of the present invention can be obtained by the carboxy alkalization of natural cellulose fibers, regenerated cellulose fibers or refined cellulose fibers by a publicly known method and, as a specific example, fibrous carboxy methyl cellulose (CMC) or fibrous carboxy ethyl cellulose can be mentioned.

Further, the substitution degree of the carboxy alkyl groups of the fibrous carboxy alkyl cellulose is 0.2-1.2, desirably, is 0.4-0.6. When the substituted degree is smaller than 0.2, even if changed to a carboxy alkyl cellulose salt by an alkalizing agent, the swelling or water dissolving ability is too low, and layer-removing ability, dispersing ability and dissolving ability becomes insufficient. Further, when the substituted degree exceeds 1.0, even if it is an acidic carboxy alkyl group which is hard to dissolve in water, it easily swells in water and since the intensity of the substrate paper is deteriorated, the possibility of causing problems such as breaking during the coating of a water base color becomes high.

In a substrate paper of the present invention, water-insoluble fibrous carboxy alkyl cellulose, which is a necessary component, and other water-dispersible fibers used for paper manufacturing can be used together. As the water-dispersible fibers used for paper manufacturing, woody pulp fibers or non-woody pulp fibers, for instance, woody pulp fibers such as conifer kraft pulp, broadleaf tree kraft pulp, dissolved pulp or mercerized pulp, non-woody pulp fibers such as flaxen pulp, Manila linen pulp or Kenaf pulp or refined cellulose fibers such as Lyocell can be mentioned. As the average fiber length of the water-dispersible fibers for paper manufacturing, 0.1-5 mm is preferably used, desirably, 0.5-3 mm, and more desirably 0.8-2 mm.

It is desirable to use water-dispersible fibers for paper manufacturing by beating them to 250-700 mlCSF, as measured by Canadian standard freeness, and more desirably to 550-650 mlCSF. In a case when the fibers are beaten until the Canadian standard freeness becomes smaller than 250 mlCSF, the fibrilization of the fibers, breaking and inner swelling increase, and the density of the substrate paper, intensity and smoothness are improved, therefore, the physical properties suited for the formation of a coating layer can be obtained. However, the water-dispersing ability becomes insufficient. On the other hand, when the beating degree is too low, the water-dispersing ability becomes good, however, the intensity and smoothness becomes insufficient and becomes porous, and the fibers are not suited for the formation of a coating layer. Therefore, the degree of beating which satisfies both the water-dispersing ability and aptitude as a substrate paper for coating is 250-700 mlCSF and desirably is 550-650 mlCSF.

The blending ratio of fibrous carboxy alkyl cellulose to a substrate paper is 5-100 wt % and more desirably is 30-60 wt %. In the case that the blending ratio of the fibrous carboxy alkyl cellulose is less than 5 wt %, the water-swelling or water-dispersible ability after an alkalizing agent is coated becomes insufficient and is not desirable.

The substrate paper can be formed as a single layer construction containing fibrous carboxy alkyl cellulose as a necessary component, however, it is possible to form a multilayer lamellar structure having 2 or more layers whose blending ratio of fibrous carboxy alkyl cellulose are different.

In the present invention, as a substrate paper containing water-insoluble fibrous carboxy alkyl cellulose, a paper of a grammage of 10-200 g/m$^2$ can be used. In particular, for a substrate paper as a coating paper for printing, a paper of a grammage larger than 50 g/m$^2$, desirably of a grammage 50-120 g/m$^2$, can be suitably used.

Further, in a case when a lamellar structure substrate is used, the grammage of each layer is 5-100 g/m$^2$ and more desirably is 10-100 g/m$^2$. Furthermore, it is desirable that a layer which contains 5 wt % or more, desirably 30 wt % or more fibrous carboxy cellulose, to be 50 wt % or more to the total grammage of the substrate paper.

In the present invention, any kind of coating layer which is formed by coating and drying a water-based color can be used and it is not particular about a single layer or multi layers, and a method for coating is not particularly restricted. Further, the materials composing a coating layer can be voluntarily chosen along with a printing method (offset printing or gravure printing) or other printing method (ink jet printer, thermal printer or laser beam printer).

In the present invention, it is necessary to coat a coating layer having characteristics suited to various printing methods on a substrate paper containing the above-mentioned fibrous carboxy alkyl cellulose. The composition of this coating layer is not restricted and can be a single layer or a multi-layer having 2 or more layers. As materials used for a coating layer, publicly known materials can be used. Examples of a coating layer suited for a thermal printer, an ink jet printer and a gravure printing are indicated as follows.

a) Coating Layer Fitted to a Thermal Printer

In a case of providing a coating paper which can be removed by water of the present invention for a printing method by a thermal printer, it is desirable to coat an undercoat layer containing a dye and a binder as the main components and a thermally sensitive recording layer containing a colorless or pale colored electron-donating leuco dye and electron-accepting color developing agent as main components on the substrate paper in order. Since the above-mentioned substrate paper possessing a porous layer (adiabatic effect is high) containing a fibrous carboxy cellulose, residue and sticking problems are ameliorated.

The smoothness of the surface of the substrate paper on which an undercoat layer is coated is not restricted, however, in general, a surface of a high smoothness is desired, and a surface contacted by a Yankee dryer or a calendaring treated surface is suitably used.

An undercoat layer is coated for the purpose of enhancing the surface smoothness of the substrate paper surface so as to accomplish the sharpness and high sensitivity of a recorded image, and can use a publicly known filling agent, binder and various additives by voluntary selection. If an undercoat layer is not provided, a substrate paper containing an alkalizing agent contacts directly with a thermally sensitive recording layer and may deteriorate the color developing sensitivity. Therefore, it is desirable to provide an undercoat layer.

As a filler for the undercoat layer, an inorganic filler such as silica, calcium carbonate, clay, kaolin, calcined kaolin, diatomaceous earth, talc, titanium oxide, aluminum hydroxide, magnesium carbonate, zinc oxide, aluminum oxide, magnesium hydroxide, barium sulfate, calcium sulfate, zinc sulfate, calcium silicate, aluminum silicate, magnesium silicate, sodium aluminosilicate, magnesium aluminum silicate or an organic filler such as a melamine resin, urea-formalin resin, polyethylene powder or nylon powder can be mentioned.

In an undercoating layer, a publicly known binder can be used. As a specific example, fully saponificated polyvinyl alcohol, partially saponificated polyvinyl alcohol, carboxyl-denatured polyvinyl alcohol, amide-denatured polyvinyl alcohol, sulfonic acid-denatured polyvinyl alcohol, butylal denatured polyvinyl alcohol, other denatured polyvinyl alcohols, hydroxyethyl cellulose, methyl cellulose, carboxy methyl cellulose, starches, gelatin, casein, sodium alginate, polyvinylpyrrolidone, polyacrylamide, a copolymer of acrylamide/acrylic ester, an alkaline salt of styrene/maleic acid anhydride, a water-soluble resin such as an alkaline salt of ethylene/maleic acid anhydride, a copolymer of styrene/butadiene, a copolymer of acrylonitrile/butadiene, a copolymer of acrylic methyl/butadiene, a ternary copolymer of acrylonitrile/butadiene/styrene, cellulose derivatives such as ethylcellulose, acetylcellulose, a water-insoluble resin such as polyvinyl chloride, polyvinyl acetate, a copolymer of vinyl acetate/acrylate, polyacrylate, a copolymer of styrene/acrylate, polyurethane resin, polyvinylbutyralpolystyrol and copolymers thereof, a polyamide resin, a silicone resin, a petroleum resin, a terpene resin, a ketone resin and a cumarone resin can be mentioned. These polymer compounds are used after being dissolved in a solvent such as water, an alcohol, ester or ketone, an ester or hydrocarbon, and further can be used in an emulsified state or past state dispersed in water or other medium and can be used according to the required quality. From the view point of the removing (releasing) ability by water, it is desirable to use starches, hydroxyethyl cellulose, methyl cellulose, carboxy methyl cellulose, gelatin, casein, sodium alginate, polyvinyl alcohol, denatured polyvinyl alcohol or polyvinylpyrrolidone as a main component of a binder.

In general, the content of a binder in an undercoat layer is 5-100 wt parts by solid to 100 wt parts of filler.

To an undercoat layer, various additives which are usually used can be used together with a filler and a binder. As various additives, a dispersing agent for a dye, a defoaming agent, a lubricant, a UV-absorbing agent, a sizing agent, a sensitizer, a fluorescent dye or a preservative can be mentioned.

An undercoat layer can be obtained by coating a coating prepared by dispersing and mixing said filler, binder and other additives forming a single layer or multi-layer using a coating machine and heating and drying by a dryer.

The coating amount of the coating by dry weight is ordinarily 0.5-50 g/m$^2$, desirably 3-15 g/m$^2$. As a coating machine, an air knife coater, a bar coater, a roll coater, a blade coater, a curtain coater, a champflex coater or a gravure coater can be mentioned.

In a thermally sensitive recording layer to be coated on an undercoat layer, publicly known leuco dyes can be used, alone or together, especially, leuco compounds of triphenylmethane dyes, fluorane dyes, phenothiazine dyes, auramine dyes, spiropyrane dyes or indolinophthalide dyes are desirably used. As a specific example, 3,3-bis(p-dimethylaminophenyl)phthalide, 3,3-bis(p-dimethylaminophenyl)-6-dimethylaminophthalide another name; Crystal Violet Lactone, 3,3-bis(p-dimethylaminophenyl)-6-diethylaminophthalide, 3,3-bis(p-dimethylaminophenyl)-6-chlorophthalide, 3,3-bis(p-dibutylaminophenyl)phthalide, 3-cyclohexylamino-6-chlorofluorane, 3-dimethylamino-5,7-dimethylfluorane, 3-diethylamino-7-chlorofluorane, 3-diethylamino-7-methylfluorane, 3-diethylamino-7,8-benzfluorane, 3-diethylamino-6-methyl-7-chlorofluorane, 3-(N-p-tolyl-N-ethylamino)-6-methyl-7-anilinofluorane, 3-pyrroridino-6-methyl-7-anilinofluorane, 2-{N-(3'-trifluoromethylphenyl)amino}-6-diethylaminofluorane, 2-{3,6-bis(diethylamino)-9-(o-chloroanilino)xanthilbenzoatelactam}, 3-diethylamino-6-methyl-7-(m-trichloromethylanilino)fluorane, 3-diethylamino-7-(o-chloroanilino)fluorane, 3-di-7-butylamino-7-(o-chloroanilino)fluorane, 3-N-methyl-N,n-amylamino)-6-methyl-7-anilinofluorane, 3-N-methyl-N-cyclohexylamino)-6-methyl-7-anilinofluorane, 3-diethylamino-6-methyl-7-anilinofluorane, 3-(N,N-diethylamino)-5-methyl-7-(N,N-dibenzylamino)fluorane, benzoylleucomethyleneblue, 6'-chloro-8'-methoxy-benzoindolino-spiropyrane, 6'-bromo-3'-methoxy-benzoindolino-spiropyrane, 3-(2'-hydroxy-4'-dimethylaminophenyl)-3-(2'-methoxy-5'-chlorophenyl) phthalide, 3-(2'-hydroxy-4'-dimethylaminophenyl)-3-(2'-methoxy-5'-nitrophenyl) phthalide, 3-(2'-hydroxy-4'-diethylaminophenyl)-3-(2'-methoxy-5'-methylphenyl) phthalide, 3-(2'-methoxy-4'-dimethylaminophenyl)-3-(2'-hydroxy-4'-chloro-5'-methylphenyl) phthalide, 3-(N-ethyl-N-tetrahydrofurfuryl)amino-6-methyl-7-anilinofluorane, 3-N-ethyl-N-(2-ethoxypropyl) amino-6-methyl-7-anilinofluorane, 3-N-methyl-N-isobutyl-6-methyl-7-anilinofluorane, 3-morpholino-7-(N-propyltrifluoromethylanilino)fluorane, 3-pyrrolidino-7-m-trifluoromethylanilinofluorane, 3-diethylamino-5-chloro-7-(N-benzyl-trifluoromethylanilino)fluorane, 3-pyrroridino-7-(di-p-chlorophnyl)methylaminofluorane, 3-diethylamino-5-chloro-7-(α-phenylethylamino)fluorane, 3-(N-ethyl-p-toluidino)-7-(α-phenylethylamino)fluorane, 3-diethylamino-7-(o-methoxycarbonylphenylamino)fluorane, 3-diethylamino-5-methyl-7-(α-phenylethylamino) fluorane, 3-diethylamino-7-piperidinofluorane, 2-chloro-3-(N-methyltoluidino)-7-(p-n-butylanilino)fluorane, 3-(N-methyl-N-isopropylamino)-6-methyl-7-anilinofluorane, 3-di-n-butylamino-6-methyl-7-anilinofluorane, 3,6-bis(dimethylamino)fluorenespiro(9,3')-6'-dimethyl aminophthalide, 3-(N-benzyl-N-cyclohexylamino)-5,6-benzo-7-(α-naphtylamino-4'-buromofluorane, 3-diethylamino-6-chloro-7-anilinofluorane, 3-diethylamino-6-methyl-7-mesitydino-4',5'-benzofluorane, 3-N-methyl-N-isopropyl-6-methyl-7-anilinofluorane, 3-N-ethyl-N-isoamyl-6-methyl-7-anilinofluorane, 3-diethylamino-6-methyl-7-(2',4'-dimethylanilino)fluorane.

Since the coating paper which can be removed by water of the present invention has a possibility of ending in a drain after use, the effect oh the environment should be considered. Therefore, among these compounds, the following compounds can be mentioned and can be used as a dye safely; 3-diethylamino-6-methyl-7-anilinofluorane, 3-dibutylamino-6-methyl-7-anilinofluorane, 3-(N-cyclohexyl-N-amino)-6-methyl-7-anilinofluorane, 3-(N-ethyl-N-isopentylamino)-6-methyl-7-anilinofluorane, 3-N-di-n-pentylamino-6-methyl-7-anilinofluorane, 3-diethylamino-7-(3-trifluoromethylanilino)fluorane, 3-(N-ethyl-N-4-methylphenylamino)-6-methyl-7-anilinofluorane, 3-diethylamino-6-methyl-7-(3-methylanilino)fluorane, 3,3'-bis(dimethylaminophenyl) -6-dimethylaminophthalide, 3-(4-diethylamino-2-ethoxyphenyl)-3-(1-ethyl-2-methylindole-3-yl)-4-azaphthalide, 2-(N-phenyl-N-methylamino)-6-(N-p-tolyl-N-ethylamino)fluorane, 3,3-bis(1-n-butyl-2-methyl-indole-3-yl)phthalide, 1,3-dimethyl-6-diethylaminofluorane and 3-bromo-3-methyl-6-dibutylaminofluorane As a color developing agent which is contained in a thermally sensitive recording layer with a leuco dye, phenols, organic acids, inorganic acids and esters or salts thereof can be used. As a specific example, gallic acid, salicylic acid, 3-isopropylsalicilate, 3-cyclohexylsalicilate, 3,5-di-tert-butylsalicilate, 3,5-di-α-methylbenzylsalicilate, 4,4'-isopropylidenediphenol, 1,1'-isopropylidenebis(2-chlorophenol), 4,4'-isopropylinebis(2,6-dibromophenol), 4,4'-isopropylidenebis(2,6-dichlorophenol), 4,4'-isopropylidenebis(2-methylphenol), 4,4'-isopropylidenebis(2,6-dimethylphenol), 4,4-isopropylidenebis(2-tert-butylphenol), 4,4'-sec-butylidenediphenol, 4,4'-cyclohexylidenebisphenol, 4,4'-cyclohexylidenebis(2-methylphenol), 4-tert-butylphenol, 4-phenylphenol, 4-hydroxydiphenoxide, α-naphthol, β-naphthol, 3,5-xylenol, thymol, methyl-4-hydroxybenzoate, 4-hydroxyacetophenone, novolac phenol resins, 2,2'-thiobis(4,6-dichlorophenol), catechol, resorcin, hydroquinone, pyrogallol, phloroglycine, phloroglycine carboxylic acid, 4-tert-octylcatecol, 2,2'-methylenebis(4-chlorophenol), 2,2'-methylenebis(4-methyl-6-tert-butylphenol), 2,2'-dihydroxydiphenyl, p-hydroxyethylbenzoate, p-hydroxypropylbenzoate, p-hydroxybutylbenzoate, p-hydroxybenzylbenzoate, p-chlorobenzy-p-hydroxybenzoate, o-chlorobenzy-p-hydroxybenzoate, p-methylbenzyl-p-hydroxybenzoate, n-octyl-p-hydroxybenzoate, benzoic acid, zincsalicilate, 1-hydroxy-2-naphthoic acid, 2-hydroxy-6-naphthoic acid, zinc2-hydroxy-6-naphthoate, 4-hydroxydiphenylsulfone, 4-hydroxy-4'-chlorodiphenylsulfone, bis(4-hydroxyphenyl)sulfide, 2-hydroxy-p-toluic acid, zinc3,5-di-tert-butylsalicilate, tin3,5-di-tert-butylsalicilate, tartarlic acid, oxalic acid, maleic acid, citric acid, succinic acid, stearic acid, 4-hydroxyphthalic acid, boric acid, thiourea derivatives, 4-hydroxythiophenol derivatives, bis(4-hydroxyphenyl)acetic acid, ethylbis(4-hydroxyphenyl)acetate, n-propylbis(4-hydroxyphenyl)acetate, n-butylbis(4-hydroxyphenyl)acetate, phenylbis(4-hydroxyphenyl)acetate, benzylbis(4-hydroxyphenyl)acetate, phenethylbis(4-hydroxyphenyl)acetate, bis(3-methyl-4-hydroxyphenyl)acetic acid, methylbis(3-methyl-4-hydroxyphenyl)acetate, propylbis(3-methyl-4-hydroxyphenyl)acetate, 1,7-bis(4-hydroxyphnylthio)3,5dioxaheptane, 1,5-bis(4-hydroxyphenylthio)3-oxa-pentane, dimethyl4-hydroxyphthalate, 4-hydroxy-4'-methoxydiphenylsulfone, 4-hydroxy-4'-ethoxydiphenylsulfone, 4-hydroxy-4'-isopropoxydiphenylsulfone, 4-hydroxy-4'-propoxydiphenylsulfone, 4-hydroxy-4'-butoxydiphenylsulfone, 4-hydroxy-4'-isobutoxydiphenylsulfone, 4-hydroxy-4'-sec-butoxydiphenylsulfone, 4-hydroxy-4'-tert-butoxydiphenylsulfone, 4-hydroxy-4'-benzyloxydiphenylsulfone, 4-hydroxy-4'-phenoxydiphenylsulfone, 4-hydroxy-4'-(m-methylbenzyloxy)diphenylsulfone, 4-hydroxy-4'-(p-methylbenzyloxy)diphenylsulfone, 4-hydroxy-4'-(o-methylbenzyloxy)diphenylsulfone and 4-hydroxy-4'-(p-chlorobenzyloxy)diphenylsulfone can be mentioned.

Since a coating paper which can be removed by water of the present invention has a possibility of being thrown into a drain after use, the effect on the environment should be considered. Therefore, the following compounds can be mentioned and can be used as the most safe color developing agents; 4,4'-dihydroxydiphenylsulfone, 2,4'-dihydroxydiphenylsulfone, 4-hydroxy-4'-isopropoxydiphenylsulfone, benzylparahydroxybenzoate, 4-hydroxy-4'-propoxydiphenylsulfone, 3-{[(phenylamino)carbonyl]amino}benzenesulfonamide, N-(4'-hydroxyphenylthio)acetyl-2-hydroxyaniline, 1:1 mixture of N-(4'-hydroxyphenylthio)acetyl-4-hydroxyaniline and N-(4'-hydroxyphenylthio)acetyl-2-hydroxyaniline, 4,4'-bis(3-(phenoxycarbonylamino)methylphenylureido)diphenyl-sulfone, a color-developing agent containing 55% of 2,2'-bis[4-(4-hydroxyphenyl sulfone)phenoxy]diphenylether, a condensation compound containing 55% of 2,2'-methylenebis(4-t-butyl phenol) {that is, containing 55% of 2,2'-methylenebis(4-t-butylphenol) and the remainder is a condensation compound consisting of a tri-nuclear condensation compound (29%), a tetra-nuclear condensation compound (11%) and a penta-nuclear condensation compound (4%) which is corresponding thereto and others being 1%}.

As a binder to be used in a thermally sensitive recording layer, the same sorts of binder used in the afore-mentioned undercoating layer can be used, however, it is not limited to them. From the view point of removability by water, it is desirable to use starches, hydroxyethyl cellulose, methyl cellulose, carboxy methyl cellulose, gelatin, casein, sodium alginate, polyvinyl alcohol, denatured polyvinyl alcohol or polyvinylpyrrolidone as a main component of a binder.

In the thermally sensitive recording layer, a supplemental additive component, for example, a sensitizer, filler, stabilizer such as metallic salt of p-nitrobenzoic acid (Ca, Zn) or metallic salt of phthalic acid mono benzyl ester (Ca, Zn), parting agent such as a metallic salt of a fatty acid, slipping agent such as a wax, inhibitor for pressure coloring, ultraviolet ray-absorbing agent, water-resisting agent such as glyoxal, dispersing agent or defoaming agent can be used when the need arises.

As a sensitizer which improves the thermal response, a thermally fusible compound is used, and a thermally fusible organic compound whose melting point is 50-200° C. can be mentioned. As a specific example, a stearic acid amide, palmitic acid amide, N-hydroxymethyl stearic acid amide, N-stearyl stearic acid amide, ethylene-bis-stearic acid amide, N-stearylurea, benzyl-2-naphthylether, m-terphenyl, 4-benzylbiphenyl, 2,2'-bis(4-methoxyphenoxy)diethylether, α, α'-diphenoxyxylene, bis(4-methoxyphenyl)ether, diphenyladipate, dibenzyloxalate, di(4-chlorobenzyl)oxalate, dimethylterephthalate, dibenzylterephthalate, phenylbenzensulfonate, bis(4-allyloxyphenyl)sulfone, 4-acetylacetophenone, aceto acetic acid anilides, fatty acid anilides, montan waxes, polyethylene wax, benzyl p-benzyloxybenzoate, di-p-tolylcarbonate, phenyl-naphthylcarbonate, 1,4-diethoxynaphthalene, phenyl 1-hydroxy-2-naphthoate, 1,2-di-(3-methylphenoxy)ethane, di(p-methylbenzyl)oxalate, benzyloxy naphthalene, 4-biphenyl p-tolylether, o-xylene-bis-(phenylether) or 4-(m-methylphnoxymethyl)biphenyl can be mentioned.

Since a coating paper which can be removed by water of the present invention has a possibility of being thrown into a drain after use, the effect on the environment should be considered. Therefore, among these compounds, the following compounds can be mentioned and can be used as a safety sensitizer; a stearic acid amide, palmitic acid amide, ethylene-bis-stearoamide, benzyl-para-benzyloxybenzoate, 4-biphenyl-para-tolylether, bis(paramethylbenzyl)oxalate, bis (parachlorobenzyl)oxalate, parabenzylbiphenyl, 1,2-bis (phenoxymethyl)benzene, para-toluenesulfonamide, ortho-toluenesulfonamide, diphenylsulfone, benzyloxynaphthalene, para-phenylacetophenone or 1,2-di-(3-methylphenoxy)ethane can be desirably used.

As a filler, the same sort of compounds used as a binder in the aforementioned undercoating layer can be used.

The amount of organic color developing agent and leuco dye, sort and amount of other components are decided according to the required physical properties and recording aptitude and not to be limited, however, in general, 0.5-10 weight parts of organic color developing agent, 0.5-10 weight parts of sensitizer to 1 parts of leuco dye are used, and regarding a filler, 5-50 weight % to the total solid amount is suitable.

The above-mentioned organic color developing agent, leuco dye and other materials to be added when need arises, are pulverized to a particle size of several micron or less using a pulverizing machine such as a ball mill, attrition or sand grinder, or by means of an adequate emulsifying apparatus, then a binder and various sorts of additives are added according to the purpose and a coating is prepared.

The forming method of a thermally sensitive recording layer is not limited and a thermally sensitive recording layer is formed by a method of coating on a substrate paper and drying it by, for example, air knife coating, rod blade coating, bar coating, blade coating, gravure coating or curtain coating. The coating amount of the coating is generally 2-12 g, desirably 3-10 g.

By providing a protective layer on a thermally sensitive recording layer, the matching ability of a thermal head or preserving ability of a recorded image can be improved.

As a binder for a protective layer, the binder used for the above-mentioned thermally sensitive recording layer can be used and not restricted, however, from the view point of removability by water, it is desirable to use starches, hydroxyethyl cellulose, methyl cellulose, carboxy methyl cellulose, gelatin, casein, sodium alginate, polyvinyl alcohol, denatured polyvinyl alcohol or polyvinylpyrrolidone as a main component of a binder.

As various additives to be used for a protective layer, a filler, surface active agent, a thermal fusible compound (or slipping agent) or an inhibitor for pressure coloring can be mentioned. In this case, as a specific example of a filler and a thermal fusible compound, same examples indicated in the above-mentioned thermally sensitive color developing layer can be used.

The protective layer can be obtained by coating a coating obtained by dispersing and mixing various additives with said binder by single layer or dividing it to a multi-layer and by heat drying by a dryer.

The coating amount of the coating is ordinary 0.2-10 g/m$^2$, desirably 0.5-5 g/m$^2$ as the weight after drying. The coating machine to be used is not specifically limited, however, a publicly known coating machine such as air knife coater, bar coater, roll coater, blade coater, curtain coater, champflex coater or gravure coater can be used.

In the present invention, it is desirable to improve the surface smoothness of the thermally sensitive recording layer side of a thermally sensitive recording paper to which an alkalizing agent is contained using a smoothing apparatus such as calendar, supercalendar or soft nip calendar. It is desirable that the Beck smoothness is 50-2000 s, more desirably 100-2000 s. When the Beck smoothness is less than 50 s, the improvement of the quality of the printed letters is not sufficient and the effect of the smoothness treatment cannot be obtained. When the Beck smoothness exceeds 2000 s, the deterioration of the water dispersibility by the improvement of the density of the substrate paper becomes remarkable, and is not desirable.

After forming an under layer on a smooth surface of a water-insoluble substrate paper and a thermally sensitive recording layer by impregnating an alkalizing agent from a non-coating surface, a thermally sensitive recording paper having a water removability can be obtained.

b) Coating Layer Fitted to an Ink Jet Printer

In a case of fitting the water removing coating paper to printing by an ink jet printer, it is desirable to form a pigment coating layer whose main components are a pigment and a water-soluble binder or a clear coating layer whose main components are cationic resins and/or a water-soluble binder, and as a pigment, a binder and various additives, publicly known compounds can be used. Further, the amount of these compounds can be suitably decided according to the required quality. Since this substrate paper has a porous layer (a layer which has high ink-absorbing capacity) in which a fibrous carboxy alkyl cellulose is contained, the ink-absorbing ability is improved.

As a pigment, the same compounds used as a filler in the afore-mentioned undercoating layer can be used, and not restricted. However, from the view point of ink-absorbing ability and color developing ability, the use of silica, alumina, calcined kaolin or calcium carbonate is desirable.

As a binder, a water-soluble resin or water-dispersible resin is desirable, and the same compounds used as a binder in the afore-mentioned undercoating layer can be used, and not restricted. However, from the view point of ink-absorbing ability and color developing ability, the use of a polyvinyl alcohol or modified polyvinyl alcohol is desirable.

As additives, a cationic resin (dye fixing agent), pigment dispersing agent, defoaming agent, lubricant, ultraviolet ray-absorbing agent, sizing agent, fluorescent dye or preservatives can be mentioned. In particular, since a cationic resin improves the water resistance of an image part and color developing ability, the use of a cationic resin is desirable.

As a coating machine, an air knife coater, bar coater, roll coater, blade coater, curtain coater, cast coater, champflex coater, gravure coater or transfer roll coater can be used.

After formation of a pigment coating layer using an aqueous coating liquid or clear coating layer on a water-insoluble substrate paper, by impregnating an alkalizing agent from a non-coating surface, an ink jet recording paper having water removability can be obtained.

c) Coating Layer Fitted to a Gravure Printing

In a case of fitting the water-removable coating paper of the present invention to gravure printing, it is desirable to form a pigment coating layer whose main components are a pigment and a water-soluble binder or a clear coating layer whose main component is a water-soluble binder and, as a pigment, a binder and various additives, publicly known compounds can be used. Further, the amount of these compounds can be voluntarily decided according to the required quality. Since this substrate paper has a porous layer (a layer which has good cushion) in which a fibrous carboxy alkyl cellulose is contained, the ink-adhering ability is improved.

As a pigment, the same compounds used as a filler in the afore-mentioned undercoating layer can be used, and not restricted.

As a binder, a water-soluble resin or water-dispersible resin is desirable, and the same compounds used as a binder in the afore-mentioned undercoating layer can be used, and is not restricted. However, from the view point of removability by water, it is desirable to contain starches, hydroxyethylcellulose; methylcellulose; carboxymethylcellulose, gelatin, casein, sodium alginate, polyvinyl alcohol, modified polyvinyl alcohol or polyvinyl pyrrolidone, which are water-dissolving resins, as a binder.

As additives, a cationic resin (printing aptitude improving agent), pigment. dispersing agent, defoaming agent, lubricant, ultraviolet ray-absorbing agent, sizing agent, fluorescent dye or preservative can be mentioned.

As a coating machine, an air knife coater, bar coater, roll coater, blade coater curtain coater, cast coater, champflex coater, gravure coater or transfer roll coater can be used.

After formation of a pigment coating layer using an aqueous coating liquid or clear coating layer on a water-insoluble substrate paper, by impregnating an alkalizing agent from a non-coating surface, a paper for gravure printing can be obtained.

In the present invention, it is necessary to impregnate an alkalizing agent into a substrate paper on which a coating layer is coated. By impregnating an alkalizing agent into a substrate paper, water-insoluble fibrous carboxy alkyl cellulose is converted to water-soluble fibrous carboxy alkyl cellulose salt by a neutralizing reaction, and the fibers in the substrate paper becomes easy to swell and dissociate and become water-dispersible. An alkalizing agent is an aqueous solution of alkaline compound and, as a specific example, a hydroxide of an alkali metal such as sodium hydroxide or potassium hydroxide, carbonate salt or hydrogen carbonate salt of an alkali metal such as sodium carbonate or sodium hydrogen carbonate, phosphoric acid salt or phosphoric hydrogen acid salt such as sodium hydrogen phosphate, organic acid salt of an alkali metal such as sodium acetate, hydroxide of an alkali earth metal such as calcium hydroxide, ammonia and ammonium salt, and amines such as ethanol amine or aqueous solution of polyethyleneimine whose molecular weight is 1000 or less can be mentioned.

The coating amount of these alkaline compounds is necessary to be equal to a neutralizing equivalent of the fibrous carboxy methyl cellulose in a substrate paper or more, desirably 1-3 times to a neutralizing equivalent or more. When the amount of the alkaline compound is smaller than the neutralizing equivalent, since the water insoluble fibrous carboxy alkyl cellulose remains, sufficient water-dispersibility cannot be obtained and, further, the carboxy alkyl cellulose bonds by itself and the solubility deteriorates remarkably. Further, when the amount of the alkaline compound exceeds 3 times the neutralizing equivalent, problems of color change or deterioration of the strength of a substrate paper or deterioration of material are caused, therefore, it is not desirable.

The containing ratio of the alkaline compound to a substrate paper is desirable to be decided suitably, because the ratio alters by the grammage of the substrate paper, substitution ratio, blending ratio and sort of fibrous carboxy alkyl cellulose to be used. For example, in a case of sodium carbonate, 0.3-67 weight % to the weight of the substrate paper, and in a case of sodium hydroxide, 0.2-51 weight % to the weight of the substrate paper.

An alkalizing agent can be coated as an aqueous solution of the above-mentioned alkaline compound or as a mixture of said aqueous solution and aqueous organic solvent which has a compatibility with said aqueous solution using an air knife coater, a bar coater, a roll coater, a blade coater, a curtain coater, a champflex coater or a gravure coater.

For the purpose of adjusting the viscosity of said aqueous solution of alkaline compound to the level suitable for a coating machine to be used or to protect the falling of the alkaline compound after drying, a water-soluble polymer which has a compatibility with said aqueous solution can be blended. As the water-soluble polymer to be used, starch and starch derivatives, cellulose derivatives such as carboxy alkyl cellulose salts, alginic acid salt or polyacrylic acid salt can be mentioned.

Further, when the water-holding capacity of the aqueous solution of alkaline compound is high (aqueous solution of alkaline compound is difficultly impregnated in a substrate paper), since the aqueous solution of an alkaline compound becomes difficult to impregnate in the whole substrate paper homogeneously, there is a tendency that the water dispersibility deteriorates. On the other hand, when the water holding capacity of the aqueous solution of alkaline compound is low (the aqueous solution of alkaline compound is easily impregnated in a substrate paper), there is a possibility that the aqueous solution of the alkaline compound effects to colorize the thermally sensitive recording layer. Therefore, regarding the aqueous solution of the alkaline compound, it is desirable that the water holding ability to a substrate paper is adjusted by a water holding agent. As an example of this water holding agent, starches and derivatives thereof, carboxy alkyl cellulose salts, hydroxyl alkyl celluloses, cellulose derivatives such as alkyl celluloses, natural polymer water holding agents such as alginic acid salts or Xanthan rubber, polyacrylic acid salts, polyvinyl alcohols, modified polyvinyl alcohols such as carboxy-denatured polyvinyl alcohols, polyvinyl pyrroridones, gelatin or kasein can be mentioned but, however, are not limited to these compounds. In the present invention, water-holding ability is a measured value of the impregnated amount of a coating liquid ($g/m^2$) into a substrate paper at a certain pressure-temperature-time and, as an example of an apparatus used for the measurement of the water-holding ability, AA-GWR water retention meter Model 1250 (product of Kaltec Co. Ltd., measuring condition: Pressure; 5 Bar, time; 40 sec, amount of coating liquid; 20 ml, filter; GWR 420) can be mentioned.

A coating paper of the present invention is preferably used as a label. For example, adhered as a mailing indication label on a returnable container, and can be removed from the container by only washing it off after being delivered. Therefore, it can save the trouble of removing it by fingers, and the working effect of the returnable container can be improved.

An adhering sheet which uses a coating paper of the present invention is a sheet characterized in having an adhesive layer on the opposite side of a coating layer (printing layer). As an adhesive which comprises said adhesive layer, a water-soluble or water-re-dispersible adhesive, especially an acrylic adhesive, is desirably used.

As an example of an acrylic adhesive, a copolymer composed of an alkoxyalkylacrylate, styrene sulfonate and other copolymerisable monomer and a compound containing a copolymer of a vinyl monomer containing a carboxyl group such as (metha)acrylic acid and a hydroxyl group-containing monomer and other copolymerisable monomers which are used when need arises. Further, as an example of a water-re-dispersible acrylic adhesive, a copolymer prepared by copolymerizing a (metha)acrylic acid alkyl ester, vinyl monomer-containing carboxyl group, vinyl monomer-containing alkoxy group and other copolymerisable monomers which are used when need arises or a composition containing a copolymer prepared by copolymerizing a vinyl monomer-containing carboxylated rosin ester, vinyl monomer-containing carboxyl group and water-soluble vinyl monomer as a base polymer can be mentioned. Carboxyl groups of these copolymers can be a salt characterized in that a part or all of them can be neutralized by an alkali, and an alkali metal salt, amine salt or alkanolamine salt are desirably used.

To these acrylic adhesives a cross-linking agent can be blended for the purpose of adjusting the adherence, water-solubility or water-dispersibility. These cross-linking agents are not limited, and can be suitably chosen from compounds which are conventionally used in an acrylic adhesives as a cross-linking agent. For example, isocyanate cross-linking agents such as 1,2-ethylenediisocyanate, epoxy cross-linking agents such as diglycidilether, melamine resins, urea resins, dialdehydes, methylol polymers, metallic chelate compounds, metallic alkoxides or metallic salts can be mentioned. Further, to said acrylic adhesives, publicly known plasticizing agents, adhering providing agents, coloring agents, thickeners, defoaming agents, leveling agents, preservatives or antioxidation agents can be suitably blended. Regarding a plasticizing agent and an adhering providing agent, for example, a water-soluble type or water-dispersible type are desirable. And as a plasticizing agent, for example, polyhydric alcohol such as sugar alcohol, polyetherpolyol or alkanol amine salt of oxidized rosin can be mentioned and, as an adhering providing agent, for example, rosin, disproportionated rosin, alkali metal salts such as hydrogenated rosin, ammonium salts or polyether esters can be mentioned.

These adhesives can be coated directly onto an alkalizing agent-coated surface of a substrate paper and an adhesive agent layer can be provided or, after forming an adhesive agent layer on a surface of a removing agent of a removing sheet by applying an adhesive agent, can transfer said layer to an alkalizing agent-coated layer by sticking it to the alkalizing agent-coated surface of the substrate paper. In any case, for the purpose of avoiding unnecessary adhesion except in actual use, a removable sheet is attached on the adhesive layer and can be used by removing it when desired. The coating amount of an adhesive layer provided on a substrate paper is 3-60 g/m$^2$ as a solid part, desirably 10-50 g/m$^2$. When the coating amount of the adhesive layer is less than 5 g/m$^2$, the adhering ability of the obtained adhering sheet is not sufficient and, on the other hand, when it exceeds 60 g/m$^2$, the adhesives easily protrude during the preparation process of an adhesive sheet or in followed process and is not desirable.

The removing sheet is not restricted and conventional publicly known sheets, for example, paper substrates such as glassine paper, coating paper, cast coating paper, laminated paper prepared by laminating thermoplastic resins such as polyethylene to said paper substrate, or various plastic films such as polyethyleneterephthalate, polypropylene or polyethylene to one surface or both surfaces having a removing agent such as silicone resin coated thereon can be mentioned. The grammage of said removing sheet is not restricted, however, in general, it is 20-120 g m$^2$.

The coating of an adhesive can be carried out by a printing method, and can be coated by pattern except for the edge part. In this case, on a removing sheet, a removing agent can be partially coated corresponding to the coating pattern of the adhesive. Further, on the coating side surface of a coating paper which can be removed by water of the present invention, the removing agent is partially coated by a discontinuous pattern of a small point or rectangular shape while, on the surface of an alkalizing agent, a pattern corresponding to that of the removing agent of the adhesive, and by piling the partially coated surface of the adhesive and partially coated surface of the removing agent, an adhesive sheet which does not need a removing sheet can be obtained.

The inventive adhesive sheet of the coating paper which can be removed by water as obtained above, after being stuck to a container, can be easily removed from the container by washing by water.

EXAMPLE

The present invention will be illustrated more in detail by the following Examples, however, the scope of the claims of the present invention are not restricted to these Examples. Parts and % respectively indicate weight parts and weight %. In the Examples, printability, removing (releasing) ability by water and water dispersibility are evaluated as-mentioned below.

Printability: Thermal Printer

Printing is carried out by using a "Bar Cord Printer 140XiII" which is a product of Zebra Co., Ltd.

A printed part printed by 0.2 mJ thermal energy of a thermal head and a ground part of a non-printed part are measured by "Macbeth RD-918" reflecting Densito Meter. A larger measured value of the printed part means a good color-developing sensitivity and a smaller measured value of a non-printed part means less ground color fogging and is excellent and printing density is measured.

Printability: Ink-jet Printer

Full surface printing (black) is carried out on a specimen using "PM-970C", which is a product of Epson Co., Ltd., and the printing density is measured by a "Macbeth RD-918" reflecting Densito Meter. Further, a Japanese character 電is printed using said printer by font 8 size and blotting of ink is evaluated by a visual inspection according to the following standard.

Evaluation of Ink Blotting

O: ink is not blotting

○: ink is slightly blotting, however, discrimination of characters is no problem Printability: Gravure Printing A gravure printer of the Ministry of Finance type (Product of Kumagai Riki Industry Co., Ltd.) is used. Dots gravure block (175 lines) and ink for gravure printing is used and printing is carried out at a 40 m/min printing speed and 10 kgf printing pressure. A 10% dots part of the printed matter is inspected using a magnifying glass and failing numbers of dots are evaluated by visual inspection according to the following standard.

Evaluation of Dots Failing Number

⭘: no failing part; very good level

○: slightly failed part is observed but no problem level

Removability by water

To an alkalizing agent layer surface of a specimen which is preserved in an atmosphere of 23° C. and 50% RH for 24 hours, a kraft paper adhesive tape was adhered, then, 5 pieces of specimens of 3 cm square was prepared. Then, 300 ml of deionized water was poured in a 300 ml beaker and one piece of said specimen was thrown into the beaker under stirring at 650 rpm using a stirrer. The time until the surface to which the adhering tape was not adhered and the specimen removed forming a layer or fragments was measured by a stopwatch, and the water removing time is obtained by averaging results from 5 tests. If the water removing time is small, removability or water-dispersing ability when contacted with water is excellent. When the water removing time is 30 seconds or less, the removability by water is ranked as excellent (indicated by mark ⭘in Table 1), if 60 seconds or less, the removability by water is ranked as good (indicated by mark ○ in Table 1) and when it exceeds 60 seconds, the removability by water is ranked as non-removable (indicated by mark X in Table 1).

Water Dispersability

From a specimen which is preserved in an atmosphere of 23° C. and 50% RH for more than 24 hours, 5 pieces of fragments of the specimen of 3 cm square are prepared. Then, 300 ml of de-ionized water is poured in 300 ml beaker and one piece of said specimen is thrown into the beaker stirring by 650 rpm using a stirrer. The time until the specimen breaks into two or more pieces is measured by a stopwatch, and the water-dispersing time is obtained by averaging the results from 5 tests. If the water-dispersing time is small, the water-dispersing ability is excellent. When the water-dispersing time is 30 seconds or less, the water-dispersing time is ranked as excellent (indicated by mark ⭘in Table 1), if 60 seconds or less, the water-dispersing time is ranked as good (indicated by mark ○ in Table 1) and when it exceeds 60 seconds, the water-dispersing time is ranked as insoluble (indicated by mark X in Table 1).

Example 1

Preparation of a Substrate Paper

A paper manufacturing material in which 50 wt parts of conifer bleached kraft pulp beaten to 550 mlCSF Canadian freeness and 50 wt parts of conifer carboxy methyl cellulose (0.43 etherification degree) are blended, is prepared, and a substrate paper of 55 g/m$^2$ grammage is manufactured using a cylinder paper machine with a Yankee dryer (manufacturing speed; 40 m/min). The smoothness of a surface contacted to a Yankee dryer is 7 s and the smoothness of the rear surface of the substrate paper is 3 s, and the wet tensile strength to the length direction is 0.12 kN/m and does not have a water dispersibility.

Coating of an Under-layer

A coating for an under-layer composed of 100 parts of calcined kaolin (product of XCI400FECC, oil-absorbing capacity of 70 ml), 0.2 parts of a dispersing agent, 80 wt parts of a 10% PVA aqueous solution and 50 parts of water is coated on a substrate paper using an air knife coater (coating speed: 200 m/min) and dried so that the dry weight is 6 g/m$^2$, and an under-layer is prepared.

Coating of a Thermally Sensitive Recording Layer

Then, a coating for a thermally sensitive recording layer composed of 36.0 parts of a dispersion of a color-developing agent, 9.2 parts of a dispersion of a dye, 12.0 parts of sensitizer, 12.0 parts of calcium carbonate (Brilliant-15, product of Shiraishi Kogyo Co., Ltd., average Particle size=50% dispersion) is coated and dried (50° C.) using an air knife coater (coating speed: 200 m/min) so that the dry weight becomes 5 g/m$^2$ and a thermally sensitive layer is formed. The color-developing agent dispersion, dye dispersion and sensitizer dispersion are prepared as follows.

Color-Developing Agent Dispersion 18.8 parts of a 10% aqueous solution of PVA, 6.0 parts of 4-hydroxy-4'-isopropoxydiphenylsulfone and 11.2 parts of water are dispersed and ground to an average particle size of 1 μm using a sand grinder.

Dye Dispersion 2.0 parts of 3-di-n-butylamino-6-methyl-7-anilinofluorane, 4.6 parts of a 10% aqueous solution of PVA and 2.6 parts of water are dispersed and ground to an average particle size of 1 μm using a sand grinder.

Sensitizer Dispersion 4.0 parts of 4-biphenyl-p-tolylether, 5.0 parts of a 10% aqueous solution of PVA and 3.0 parts of water are dispersed and ground to an average particle size of 1 μm using a sand grinder.

Smoothing Treatment 1

After the thermal sensitive recording layer is coated, smoothing treatment is carried out using a calendar so that the Beck smoothness of the thermal sensitive recording layer surface becomes 200-300 sec.

Impregnation of Alkalizing Agent

Then, an aqueous solution of 10 wt % sodium carbonate is coated and dried (40° C.) using an air knife coater (coating speed: 200 m/min) so that the dry weight becomes 5 g/m$^2$, the coating amount of which corresponds to 1.5 times the neutralization equivalent, and an alkalizing agent layer is impregnated in a substrate paper.

Smoothing Treatment 2

After said alkalizing agent layer is coated, smoothing treatment is carried out using a calendar so that the Beck smoothness of thermal sensitive recording layer surface becomes 200-300 sec, and a water-decaying coating paper (thermally sensitive recording paper) of the present invention is obtained.

Physical properties of the obtained coating paper which can be removed by water obtained as above (printability, removability by water and water dispersibility) are evaluated. The results are shown in Table 1 and Table 2.

Example 2

Preparation of Substrate Paper

Paper manufacturing material in which 5 wt parts of conifer bleached kraft pulp beaten to 550 mlCSF Canadian freeness and 95 wt parts of fibrous carboxymethyl cellulose (0.43 etherification degree) are blended is prepared, and a substrate paper of 55 g/m$^2$ grammage is manufactured using a cylinder paper machine with a Yankee dryer paper manufacturing machine (manufacturing speed: 40 m/min). The smoothness of a surface contacted to a Yankee dryer is 4 s, the smoothness of the rear surface of the substrate paper is 2 s, the wet tensile strength to the length direction is 0.14 kN/m and it does not have a water dispersibility.

By the same process as Example 1, except for using the above substrate paper, a coating paper which can be removed by water is prepared and the estimation results of the physical properties are shown in Table 1 and Table 2.

Example 3

Preparation of Substrate Paper

Paper manufacturing material in which 40 wt parts of conifer bleached kraft pulp beaten to 550 mlCSF Canadian freeness and 60 wt parts of fibrous carboxymethyl cellulose (0.43 etherification degree) are blended is prepared, and a substrate paper of 55 g/m$^2$ grammage is manufactured using a Yankee dryer paper manufacturing machine (manufacturing speed: 40 m/min). The smoothness of a surface contacted to a Yankee dryer is 6 s, the smoothness of a rear surface of the substrate paper is 2 s, the wet tensile strength to the length direction is 0.14 kN/m and it does not have a water dispersibility.

By the same process as Example 1 except for using the above substrate paper, a coating paper which can be removed by water is prepared and the estimation results of the physical properties are shown in Table 1 and Table 2.

Example 4

Preparation of Substrate Paper

A paper manufacturing material in which 70 wt parts of conifer bleached kraft pulp beaten to 550 mlCSF Canadian freeness and 30 wt parts of fibrous carboxymethyl cellulose (0.43 etherification degree) are blended is prepared, and a substrate paper of 55 g/m$^2$ grammage is manufactured using a cylinder paper machine with a Yankee dryer paper manufacturing machine (manufacturing speed: 40 m/min). The smoothness of a surface contacted to the Yankee dryer is 12 s, the smoothness of a rear surface of the substrate paper is 3 s, the wet tensile strength to the length direction is 0.12 kN/m and it does not have a water dispersibility.

By the same process as Example 1, except for using the above substrate paper, a coating paper which can be removed by water is prepared and the estimation results of the physical properties are shown in Table 1 and Table 2.

Example 5

Preparation of Substrate Paper

A paper manufacturing material in which 80 wt parts of conifer bleached kraft pulp beaten to 550 mlCSF Canadian freeness and 20 wt parts of fibrous carboxymethyl cellulose (0.43 etherification degree) are blended, is prepared, and a substrate paper of 55 g/m$^2$ grammage is manufactured using a cylinder paper machine with a Yankee dryer paper manufacturing machine (manufacturing speed: 40 m/min). The smoothness of a surface contacted to the Yankee dryer is 12 s, the smoothness of a rear surface of the substrate paper is 3 s, the wet tensile strength to the length direction is 0.12 kN/m and it does not have a water dispersibility.

By the same process as Example 1, except for using the above substrate paper, a coating paper which can be removed by water is prepared and the estimation results of the physical properties are shown in Table 1 and Table 2.

Example 6

Preparation of Substrate Paper

A paper manufacturing material in which 80 wt parts of conifer bleached kraft pulp beaten to 550 mlCSF Canadian freeness and 20 wt parts of fibrous carboxymethyl cellulose (0.43 etherification degree) are blended, is prepared, and a substrate paper of 65 g/m$^2$ grammage is manufactured using a cylinder paper machine with a Yankee dryer paper manufacturing machine (manufacturing speed: 40 m/min). The smoothness of a surface contacted to a Yankee dryer is 12 s, the smoothness of a rear surface of the substrate paper is 3 s, the wet tensile strength to the length direction is 0.13 kN/m and it does not have a water dispersibility.

By the same process as Example 1, except for using the above substrate paper, a coating paper which can be removed by water is prepared and the estimation results of the physical properties are shown in Table 1 and Table 2.

Example 7

Preparation of Substrate Paper

A paper manufacturing material in which 50 wt parts of conifer bleached kraft pulp beaten to 550 mlCSF Canadian freeness and 50 wt parts of fibrous carboxy methyl cellulose (0.43 etherification degree) are blended, is prepared, and a substrate paper of 65 g/m$^2$ grammage is manufactured using a cylinder paper machine with a Yankee dryer paper manufacturing machine (manufacturing speed: 40 m/min). The smoothness of a surface contacted to a Yankee dryer is 9 s, the smoothness of a rear surface of the substrate paper is 3 s, the wet tensile strength to the length direction is 0.13 kN/m and it does not have a water dispersibility.

By the same process as Example 1, except for using the above substrate paper, a coating paper which can be removed by water is prepared and the estimation results of the physical properties are shown in Table 1 and Table 2.

Example 8

Preparation of Substrate Paper

A paper manufacturing material in which 50 wt parts of conifer bleached kraft pulp beaten to 350 mlCSF Canadian freeness and 50 wt parts of fibrous carboxy methyl cellulose (0.43 etherification degree) are blended, is prepared, and a substrate paper of 55 g/m grammage is manufactured using a cylinder paper machine with a Yankee dryer paper manufacturing machine (manufacturing speed: 40 m/min). The smoothness of a surface contacted to a Yankee dryer is 14 s, the smoothness of a rear surface of the substrate paper is 3 s, the wet tensile strength to the length direction is 0.14 kN/m and it does not have a water dispersibility.

By the same process as Example 1, except for using the above substrate paper, a coating paper which can be removed by water is prepared and the estimation results of the physical properties are shown in Table 1 and Table 2.

Example 9

By the same process as Example 1, except for using potassium carbonate as an alkaline compound, a coating paper which can be removed by water of the present invention is prepared and the estimation results of the physical properties are shown in Table 1 and Table 2.

Example 10

By the same process as Example 1, except using a 3 wt % aqueous solution of sodium hydroxide as an alkaline compound and a coating amount of 2.6 g/m$^2$ by dry weight, a coating paper which can be removed by water of the present invention is prepared and the estimation results of the physical properties are shown in Table 1 and Table 2.

Example 11

By the same process as Example 1, except for using ammonia as an alkaline compound, a coating paper which can be removed by water of the present invention is prepared and the estimation results of the physical properties are shown in Table 1 and Table 2.

Example 12

By the same process as Example 1, except for using triethanolamine as an alkaline compound, a coating paper which can be removed by water of the present invention is prepared and the estimation results of the physical properties are shown in Table 1 and Table 2.

Example 13

By the same process as Example 1, except using polyethyleneimine whose molecular weight is 300 as an alkaline compound, a coating paper which can be removed by water of the present invention is prepared and the estimation results of the physical properties are shown in Table 1 and Table 2.

Example 14

Preparation of Substrate Paper

A substrate paper of 55 g/m$^2$ grammage is manufactured by adhering a moisture paper A (dry grammage: corresponding to 10 g/m$^2$) manufactured from a paper manufacturing material composed of 75 wt % of broadleaf tree and 25 wt % of conifer bleached kraft pulp which are beaten to 550 mlCSF Canadian freeness and a moisture paper B (dry grammage: corresponding to 45 g/m$^2$) manufactured from a paper manufacturing material composed of 50 wt parts of conifer bleached kraft pulp beaten to 680 mlCSF Canadian freeness and 50 weight parts of fibrous carboxy methyl cellulose (0.43 etherification degree) using a cylinder paper machine with Yankee dryer having two cylinders (manufacturing speed: 40 m/min). The smoothness of a surface contacted to a Yankee dryer is 12 s, the smoothness of a rear surface of the substrate paper is 3 s, the wet tensile strength to the length direction is 0.13 kN/m and it does not have a water dispersibility.

To the moisture paper A side surface of the substrate paper, an under-layer and a thermally sensitive recording layer are coated and, to the moisture paper B side surface of the substrate paper, an alkalization agent is contained and then calendaring treatment is carried out. Thus, a thermally sensitive recording paper of the present invention is prepared and the estimation results of the physical properties are shown in Table 1 and Table 2.

Example 15

Preparation of Substrate Paper

A substrate paper of 55 g/m$^2$ grammage is manufactured by adhering a moisture paper A consisting of 75 wt % of a broadleaf tree of 55 g/m$^2$ grammage is manufactured and 25 wt % of conifer bleached kraft pulp which are beaten to 550 mlCSF Canadian freeness (dry grammage: corresponding to 25 g/m$^2$) and a moisture paper B manufactured from paper manufacturing material in which 50 wt parts of conifer bleached kraft pulp beaten to 680 mlCSF Canadian freeness and 50 wt parts of fibrous carboxy methyl cellulose (0.43 etherification degree) are blended (dry grammage: corresponding to 30 g/m$^2$) using a cylinder paper machine with a Yankee dryer having two cylinders (manufacturing speed: 40 m/min). The smoothness of a surface contacted to the Yankee dryer is 12 s, the smoothness of rear surface of the substrate paper is 3 s, the wet tensile strength to the length direction is 0.13 kN/m and it does not have a water dispersibility.

To the moisture paper A side surface of the substrate paper, an under layer and a thermally sensitive recording layer are coated, and to the moisture paper B side surface of the substrate paper, an alkalization agent is contained, then calendaring treatment is carried out, thus a coating paper which can be removed by water (thermally sensitive recording paper) of the present invention is prepared and the estimation results of the physical properties are shown in Table 1 and Table 2.

Example 16

By the same process as Example 1, except for changing the coating amount of the alkalizing agent to 0.34 g/m$^2$ (dry weight), which corresponds to 10% of a neutralization equivalent, a thermally sensitive recording paper is prepared.

The physical properties (printability, removability by water and water dispersibility) of the thermally sensitive recording paper prepared as above are estimated and the results are shown in Table 1 and Table 2.

Example 17

By the same process as Example 1, except for changing the coating amount of the alkalizing agent to 6.70 g/m$^2$ (dry weight), which corresponds to 200% of a neutralization equivalent, a thermally sensitive recording paper is prepared.

The physical properties (printability, removability by water and water dispersibility) of the thermally sensitive recording paper prepared as above are estimated and the results are shown in Table 1 and Table 2.

Example 18

Coating of a Protecting Layer

On a thermally sensitive recording layer of the thermally sensitive recording paper of Example 1, a coating liquid containing 500 weight parts of an aqueous solution polyvinyl alcohol containing an aceto-acetic acid ester group (product of Nippon Gose Kagaku Kogyo Co., Ltd., Commodity name "Gosefaimer Z200") (solid part conc. is 10 wt %) and 80 weight parts of an aqueous dispersion of calcium carbonate (solid part conc. is 30 wt %) is coated so that the dry weight becomes 1.5 g/m$^2$ using a wire rod coater by 300 m/min speed, and a protecting layer is formed.

Coating of an Adhesive Layer 100 weight parts of a water-soluble emulsion type acrylic adhesive (product of Nippon Industries Co., Inc., Commodity name "Nikasol HS002" solid part conc.: 40 wt %) and 2 weight parts of an epoxy resin cross-linking agent (product of Nippon Carbide Industries Co., Inc., Commodity name "FX-931" solid part conc.: 10 wt %) are mixed and an adhesive coating liquid is prepared. The obtained adhesive coating liquid is coated on a removing surface of a removing sheet (product of Mishima Paper Co., Ltd., "35SIP", grammage: 36 g/m$^2$) to which a silicone removing agent is coated so that the coating amount as solids is 30 g/m$^2$ and dried. Thus, an adhesive layer is prepared. This adhesive layer is stuck with the surface of an alkalizing agent layer side of the thermally sensitive recording paper to which the above-mentioned protective layer is formed and a thermally sensitive recording paper with an adhesive layer is prepared.

The physical properties (printability, water removability, water dispersibility) of the coating paper which can be removed by water (thermally sensitive recording paper) prepared as above are estimated and the results are shown in Table 1 and Table 2. Moreover, the estimation of the disentangling ability is estimated by barking a removing sheet.

Example 19

Preparation of Substrate Paper

A substrate paper of 55 g/m$^2$ grammage is manufactured by adhering a moisture paper A (dry grammage: corresponding to 25 g/m$^2$) manufactured from a paper manufacturing material composed of 75 wt % of a broadleaf tree and 25 wt % of conifer bleached kraft pulp which are beaten to 550 mlCSF Canadian freeness and a moisture paper B (dry grammage: corresponding to 30 g/m$^2$) manufactured from a paper manufacturing material composed of 50 wt parts of conifer bleached kraft pulp beaten to 650 mlCSF Canadian freeness and 50 wt parts of fibrous carboxy methyl cellulose (0.43 etherification degree) using a cylinder paper machine with a Yankee dryer having two cylinders (manufacturing speed: 40 m/min). The smoothness of a surface contacted to the Yankee dryer is 12 s, the smoothness of a rear surface of the substrate paper is 3 s, the wet tensile strength to the length direction is 0.13 kN/m and it does not have a water dispersibility.

To the moisture paper A side surface of the substrate paper, a pigment layer mentioned below is coated, and to the moisture paper B side surface of the substrate paper, an alkalizing agent is impregnated. After that, calendaring treatment is carried out and a coating paper which can be removed by water (ink jet recording medium) of the present invention is prepared. The estimation results are shown in Table 1 and Table 2.

Coating of a Pigment Coating Layer

To the moisture paper A side (smooth surface) of the substrate paper, a coating liquid for a pigment coating layer composed of 100 parts of silica (product of Tokuyama Corporation, commodity name: "Fainsil X37B"20% dispersion), 50 parts of 10% PVA solution, 2 parts of cationic resin (product of Seiko PMC Co., Ltd. and a dye-fixing agent, commodity name "SRD-150" 50%) is coated so that the dry weight is 10 g/m$^2$ using a blade coater at 300 m/min speed, then dried and a pigment layer is formed.

Impregnation of Alkalizing Agent

Then, to the moisture paper B side of the substrate paper, a 10 wt % conc. sodium carbonate aqueous solution is coated so that the coating amount is 2.7 g/m$^2$ (dry weight), which corresponds to 1.5 times the neutralizing equivalent, using an air knife coater at a coating speed of 200 m/min and dried (40° C.). Thus, an alkalizing agent layer is impregnated in a substrate paper.

Example 20

Preparation of a Substrate Paper

Paper manufacturing material in which 50 wt parts of conifer bleached kraft pulp beaten to 550 mlCSF Canadian freeness and 50 wt parts of fibrous carboxy methyl cellulose (0.43 etherification degree) are blended, is prepared, and a substrate paper of 55 g/m$^2$ grammage is manufactured using a cylinder paper machine with a Yankee dryer (manufacturing speed: 40 m/min). The smoothness of a surface in contact with the Yankee dryer is 7 s, the smoothness of the rear surface of the substrate paper is 3 s, the wet tensile strength to the length direction is 0.12 kN/m and it does not have a water dispersibility.

Coating of a Pigment Coating Layer

A 70% pigment dispersion composed of 100 parts of kaolin (product of Imelis Co., Ltd., commodity name is "Premium") and 0.2 parts of a dispersing agent (sodium polyacrylate) and a coating liquid for a pigment coating layer composed of 10.5 parts of a 20% polyvinyl alcohol solution (product of Kuraray commodity name "PVA105") and 2 parts of a 35% solution of hydroxymethylated starch (commodity name "Penfordgam 295") are coated on the surface of a substrate paper so that the dry weight is 12 g/m$^2$ using a blade coater at 500 m/min speed and dried and a pigment coating layer is formed.

Impregnation of Alkalizing Agent

Then, to the moisture paper B side of the substrate paper, a 10 wt % conc. sodium carbonate aqueous solution is coated so that the coating amount is 2.7 g/m$^2$ (dry weight), which corresponds to 1.5 times the neutralizing equivalent using an air knife coater at a coating speed of 200 m/min and dried (40° C.). Thus, an alkalizing agent layer is impregnated in a substrate paper.

Smoothing Treatment

After said alkalizing agent layer is coated, super calendar treatment is carried out under the conditions of roller temperature: 65° C., two nips, calendar linear pressure: 150 kg/cm paper feeding speed: 10 m/min and a water-decaying coating paper (paper for gravure printing) is obtained.

Example 21

By the same process as Example 1, except for using a mixture of 100 parts of a 10 wt % conc. aqueous solution of sodium carbonate and 10 parts of a modified acrylic water holding agent (product of San Nopco Limited, commodity name SN Thickener 929-S, solids content of 12%) as an alkalizing agent layer and a thermally sensitive recording paper is prepared.

The physical properties (printability, removability by water and water dispersibility) of the thermally sensitive recording paper prepared as above are estimated and the results are shown in Table 1 and Table 2.

Example 22

By the same process as Example 1, except for using a mixture of 100 parts of a 10 wt % conc. aqueous solution of sodium carbonate and 30 parts of a modified acrylic water holding agent (product of San Nopco Limited, commodity name SN Thickener 929-S, solids content of 12%) as an alkalizing agent layer and a thermally sensitive recording paper is prepared.

The physical properties (printability, removability by water and water dispersibility) of the thermally sensitive recording paper prepared as above are estimated and the results are shown in Table 1 and Table 2.

Example 23

By the same process as Example 1, except for using a condensation compound containing 55% of 2,2'-methylenebis(4-t-butyl phenol) {that is, containing 55% of 2,2'-methylenebis(4-t-butyl phenol) and the remainder is a condensation compound consisting of a tri-nuclear condensation compound (29%), a tetra-nuclear condensation compound (11%) and a penta-nuclear condensation compound (4%), which corresponds thereto, and others is 1%} as a color developing agent, a thermally sensitive recording layer is prepared and the estimation results of the physical properties are shown in Table 1 and Table 2.

Example 24

By the same process as Example 1, except for using 3-(N-ethyl-N-isopentylamino)-6-methyl-7-anilinofluorane as a dye, a thermally sensitive recording paper of the present invention is prepared, and the estimation results of the physical properties are shown in Table 1 and Table 2.

Example 25

By the same process as Example 1, except for using 1,2-bis(3-methylphenoxy) ethane as a sensitizer, a thermally sensitive recording paper of the present invention is prepared, and the estimation results of the physical properties are shown in Table 1 and Table 2.

Comparative Example 1

Preparation of a Substrate Paper

A paper manufacturing material in which 96 weight parts of conifer bleached kraft pulp beaten to 550 mlCSF Canadian freeness and 4 weight parts of fibrous carboxy methyl cellulose (0.43 etherification degree) are blended, is prepared, and a substrate paper of 55 g/m$^2$ grammage is manufactured using a cylinder paper machine with a Yankee dryer (manufacturing speed: 40 m/min). The smoothness of a surface in contact with the Yankee dryer is 22 s, the smoothness of the rear surface of the substrate paper is 4 s, the wet tensile strength to the length direction is 0.14 kN/m and it does not have a water dispersibility.

By the same process as Example 1, except for using said substrate paper, a coating paper which can be removed by water is prepared and the estimation results of the physical properties are shown in Table 1 and Table 2.

Comparative Example 2

Preparation of a Substrate Paper

A paper manufacturing material is prepared by beating conifer bleached kraft pulp to 550 mlCSF Canadian freeness and a substrate paper of 55 g/m$^2$ grammage is manufactured using a cylinder paper machine with a Yankee dryer (manufacturing speed: 40 m/min). The smoothness of a surface in contact with the Yankee dryer is 20 s, the smoothness of the rear surface of the substrate paper is 9 s, the wet tensile strength to the length direction is 0.12 kN/m and it does not have a water dispersibility.

By the same process as Example 1, except for using said substrate paper, a coating paper which can be removed by water is prepared and the estimation results of the physical properties are shown in Table 1 and Table 2.

Comparative Example 3

Preparation of a Substrate Paper

A paper manufacturing material is prepared by beating conifer bleached kraft pulp to 550 mlCSF Canadian freeness and a substrate paper of 55 g/m$^2$ grammage is manufactured using a cylinder paper machine with a Yankee dryer (manufacturing speed: 40 m/min). The smoothness of a surface in contact with the Yankee dryer is 20 s, the smoothness of the rear surface of the substrate paper is 9 s, the wet tensile strength to the length direction is 0.12 kN/m and it does not have a water dispersibility.

By the same process as Example 19, except for using said substrate paper, a coating paper which can be removed by water is prepared and the estimation results of the physical properties are shown in Table 1 and Table 2.

Comparative Example 4

Preparation of a Substrate Paper

A paper manufacturing material in which 96 weight parts of conifer bleached kraft pulp beaten to 550 mlCSF Canadian freeness and 4 weight parts of fibrous carboxy methyl cellulose (0.43 etherification degree) are blended, is prepared, and a substrate paper of 55 g/m$^2$ grammage is manufactured using a cylinder paper machine with a Yankee dryer paper manufacturing machine (manufacturing speed: 40 m/min). The smoothness of a surface in contact with the Yankee dryer is 22 s, the smoothness of the rear surface of the substrate paper is 4 s, the wet tensile strength to the length direction is 0.14 kN/m and it does not have a water dispersibility.

By the same process as Example 20, except using said substrate paper, a coating paper which can be removed by water is prepared and the estimation results of the physical properties are shown in Table 1 and Table 2.

Comparative Example 5

By the same process as Example 20, except for using a water-soluble paper (product of Mishima Paper Co., Ltd., commodity name 60 MDP), a coating liquid for an undercoat layer is tried to coat on a smooth surface of a substrate paper so that the dry weight is 6 g/m$^2$ using a blade coater. However, the substrate paper swells from the coating liquid for an undercoat layer and the substrate paper is broken. Therefore, the undercoat layer cannot be formed. Further, a coating liquid for thermally sensitive recording layer is tried to coat on a smooth surface of a substrate paper without coating an undercoat layer so that the dry weight is 5 g/m$^2$ using an air knife coater. However, the substrate paper swells from the coating liquid for an undercoat layer and the substrate paper is broken. Therefore, the thermally sensitive layer cannot be formed.

TABLE 1

| | pulp | | CMC | | | | alkalizing agent | |
|---|---|---|---|---|---|---|---|---|
| | freeness | blending amount | substitution degree | blending amount | gramage | coating layer | sort | amount |
| Ex. 1 | 550 | 50 | 0.43 | 50 | 55 | thermal | $Na_2CO_3$ | 1.5 |
| Ex. 2 | 550 | 5 | 0.43 | 95 | 55 | thermal | $Na_2CO_3$ | 1.5 |
| Ex. 3 | 550 | 40 | 0.43 | 60 | 55 | thermal | $Na_2CO_3$ | 1.5 |
| Ex. 4 | 550 | 70 | 0.43 | 30 | 55 | thermal | $Na_2CO_3$ | 1.5 |
| Ex. 5 | 550 | 80 | 0.43 | 20 | 55 | thermal | $Na_2CO_3$ | 1.5 |
| Ex. 6 | 550 | 80 | 0.43 | 20 | 65 | thermal | $Na_2CO_3$ | 1.5 |
| Ex. 7 | 550 | 50 | 0.43 | 50 | 65 | thermal | $Na_2CO_3$ | 1.5 |
| Ex. 8 | 350 | 50 | 0.43 | 50 | 55 | thermal | $Na_2CO_3$ | 1.5 |
| Ex. 9 | 550 | 50 | 0.43 | 50 | 55 | thermal | $Na_2CO_3$ | 1.5 |
| Ex. 10 | 550 | 50 | 0.43 | 50 | 55 | thermal | $K_2CO_3$ | 1.5 |
| Ex. 11 | 550 | 50 | 0.43 | 50 | 55 | thermal | NaOH | 1.5 |
| Ex. 12 | 550 | 50 | 0.43 | 50 | 55 | thermal | ammonia | 1.5 |
| Ex. 13 | 550 | 50 | 0.43 | 50 | 55 | thermal | amines | 1.5 |
| Ex. 14 | 680 | 50 | 0.43 | 50 | 45 | thermal | imines | 1.5 |
| | 550 | 100 | — | — | 10 | | | |
| Ex. 15 | 680 | 50 | 0.43 | 50 | 30 | thermal | $Na_2CO_3$ | 1.5 |
| | 550 | 100 | — | — | 25 | | | |
| Ex. 16 | 550 | 50 | 0.43 | 50 | 55 | thermal | $Na_2CO_3$ | 0.1 |
| Ex. 17 | 550 | 50 | 0.43 | 50 | 55 | thermal | $Na_2CO_3$ | 2 |
| Ex. 18 | 550 | 50 | 0.43 | 50 | 55 | thermal/ adhesive | $Na_2CO_3$ | 1.5 |
| Ex. 19 | 680 | 50 | 0.43 | 50 | 45 | ink jet | $Na_2CO_3$ | 1.5 |
| | 550 | 100 | — | — | 10 | | | |
| Ex. 20 | 550 | 50 | 0.43 | 50 | 55 | gravure | $Na_2CO_3$ | 1.5 |
| Ex. 21 | 550 | 50 | 0.43 | 50 | 55 | thermal | $Na_2CO_3$ | 1.5 |
| Ex. 22 | 550 | 50 | 0.43 | 50 | 55 | thermal | $Na_2CO_3$ | 1.5 |
| Ex. 23 | 550 | 50 | 0.43 | 50 | 55 | thermal | $Na_2CO_3$ | 1.5 |
| Ex. 24 | 550 | 50 | 0.43 | 50 | 55 | thermal | $Na_2CO_3$ | 1.5 |
| Ex. 25 | 550 | 50 | 0.43 | 50 | 55 | thermal | $Na_2CO_3$ | 1.5 |
| Co. Ex. 1 | 550 | 96 | 0.43 | 4 | 55 | thermal | $Na_2CO_3$ | 1.5 |
| Co. Ex. 2 | 550 | 100 | — | — | 55 | thermal | $Na_2CO_3$ | 1.5 |
| Co. Ex. 3 | 550 | 100 | — | — | 55 | ink jet | $Na_2CO_3$ | 1.5 |
| Co. Ex. 4 | 550 | 96 | 0.43 | 4 | 55 | gravure | $Na_2CO_3$ | 1.5 |
| Co. Ex. 5 | water soluble paper in the market | | | | 60 | — | $Na_2CO_3$ | — |

CMC: carboxy methyl cellulose
Co. Ex.: Comparative Example
amines is triethanol amine and imines is polyethylene imine.

TABLE 2

| | quality | printing ability thermal | | printing ability ink jet | | printing ability |
|---|---|---|---|---|---|---|
| | solubility | ground part | image part | density | fogging | gravure |
| Ex. 1 | ◎ | 0.07 | 1.41 | — | — | — |
| Ex. 2 | ◎ | 0.07 | 1.38 | — | — | — |
| Ex. 3 | ◎ | 0.08 | 1.40 | — | — | — |
| Ex. 4 | ◎ | 0.07 | 1.42 | — | — | — |
| Ex. 5 | ○ | 0.08 | 1.42 | — | — | — |
| Ex. 6 | Δ | 0.07 | 1.41 | — | — | — |
| Ex. 7 | ◎ | 0.07 | 1.40 | — | — | — |
| Ex. 8 | Δ | 0.08 | 1.43 | — | — | — |
| Ex. 9 | ◎ | 0.07 | 1.40 | — | — | — |
| Ex. 10 | ◎ | 0.07 | 1.38 | — | — | — |
| Ex. 11 | ◎ | 0.08 | 1.41 | — | — | — |
| Ex. 12 | ◎ | 0.07 | 1.41 | — | — | — |
| Ex. 13 | ◎ | 0.07 | 1.40 | — | — | — |
| Ex. 14 | ○ | 0.07 | 1.42 | — | — | — |
| Ex. 15 | Δ | 0.07 | 1.41 | — | — | — |
| Ex. 16 | Δ | 0.07 | 1.43 | — | — | — |
| Ex. 17 | ◎ | 0.08 | 1.38 | — | — | — |
| Ex. 18 | ◎ | 0.07 | 1.33 | — | — | — |
| Ex. 19 | ○ | — | — | 1.72 | ◎ | — |
| Ex. 20 | ◎ | — | — | — | — | ◎ |
| Ex. 21 | ◎ | 0.07 | 1.47 | — | — | — |
| Ex. 22 | ○ | 0.07 | 1.48 | — | — | — |

TABLE 2-continued

| | quality | printing ability thermal | | printing ability ink jet | | printing ability |
|---|---|---|---|---|---|---|
| | solubility | ground part | image part | density | fogging | gravure |
| Ex. 23 | ◎ | 0.07 | 1.42 | — | — | — |
| Ex. 24 | ◎ | | 1.40 | — | — | — |
| Ex. 25 | ◎ | 0.07 | 1.43 | — | — | — |
| Co. Ex. 1 | X | 0.07 | 1.45 | — | — | — |
| Co. Ex. 2 | X | 0.07 | 1.44 | — | — | — |
| Co. Ex. 3 | X | — | — | 1.75 | ○ | — |
| Co. Ex. 4 | X | — | — | | | ○ |
| Co. Ex. 5 | — | — | — | — | — | — |

Co. Ex.: Comparative Example

Possibility for Industrial Use

The coating paper of this invention has characteristics of the thermally sensitive layer being easily removed and dispersed by contact with water, besides a good printing aptitude, and can be used preferably as a label for a returnable container.

What is claimed is:

1. A water-removable coating paper comprising a substrate paper having a grammage of at least 50 g/m$^2$ and comprising a water-decaying layer containing 30-60 wt. % of a water-insoluble, fibrous carboxyalkylcellulose, 40-70 wt. % of water-dispersible fibers beaten to a CSF value of from 550-650 ml, according to JIS-P8121, and an alkalizing agent and a water-based color coated on the substrate paper.

2. The coating paper of claim 1, wherein the alkalizing agent is at least one member selected from the group consisting of an alkali metal hydroxide, an alkali metal salt, ammonia, an amine and an imine and, further, the amount of said alkalizing agent is at least equal to a neutralization equivalent of the fibrous carboxy alkyl cellulose contained in the water-decaying layer.

3. The coating paper of claim 1, wherein the water-based color contains a colorless or pale-colored electron-donating leuco dye and an electron-accepting color developing agent as main components.

4. The coating paper of claim 1, further comprising an adhesive agent layer provided on a non-coating surface of the substrate paper.

5. The coating paper which can be removed by water of claim 2, wherein the water-based color contains a colorless or pale-colored electron-donating leuco dye and electron-accepting color developing agent as main components.

6. The coating paper which can be removed by water of claim 2, further comprising an adhesive agent layer provided on a non-coating surface of the substrate paper.

7. The coating paper which can be removed by water of claim 3, further comprising an adhesive agent layer provided on a non-coating surface of the substrate paper.

8. The coating paper which can be removed by water of claim 5, further comprising an adhesive agent layer provided on a non-coating surface of the substrate paper.

9. A method of preparing a coated paper which can be removed with water, comprising the steps of:

providing a substrate comprising a water-decaying layer containing 5-100 wt. % of a water-insoluble, fibrous carboxyalkylcellulose;

coating a water-based color on one surface of the substrate paper; and impregnating an alkalizing agent into the substrate through a non-coated surface.

10. The method of claim 9, additionally comprising the step of coating or adhering an adhesive layer on the surface through which the alkalizing agent is impregnated.

11. A method of preparing a coating paper which can be removed with water, comprising the steps of:

providing a substrate paper having a grammage of at least 50 g/m$^2$ and comprising a water-decaying layer containing 30-60 wt. % of a water-insoluble, fibrous carboxyalkylcellulose and 40-70 wt. % of water-dispersible fibers beaten to a CSF value of from 550-650 ml, according to JIS-P8121;

coating a water-based color on one surface of the substrate paper; and impregnating an alkalizing agent into the substrate through a non-coated surface.

* * * * *